US005967865A

United States Patent [19]

Nakamura et al.

[11] Patent Number: 5,967,865

[45] Date of Patent: Oct. 19, 1999

[54] OUTBOARD SPLASH PLATE ARRANGEMENT

[75] Inventors: Daisuke Nakamura; Atsushi Kumita, both of Hamamatsu, Japan

[73] Assignee: Sanshin Kogyo Kabushiki Kaisha, Hamatsu, Japan

[21] Appl. No.: 08/953,012

[22] Filed: Oct. 16, 1997

[30] Foreign Application Priority Data

Oct. 16, 1996 [JP] Japan ..... 8-293124

[51] Int. Cl.[6] ..... B63H 1/15

[52] U.S. Cl. ..... 440/52; 440/76

[58] Field of Search ..... 440/52, 76, 78, 440/53

[56] References Cited

U.S. PATENT DOCUMENTS

| | | | |
|---|---|---|---|
| 2,118,209 | 5/1938 | Linthwaite | 440/78 |
| 4,323,355 | 4/1982 | Kondo | 440/76 |
| 4,507,090 | 3/1985 | Kobayashi et al. | 440/52 |
| 4,583,953 | 4/1986 | Nakase | 440/52 |
| 4,615,683 | 10/1986 | Harada et al. | 440/52 |
| 4,723,926 | 2/1988 | Uehara | 440/52 |
| 4,726,795 | 2/1988 | Uehara | 440/52 |
| 4,810,218 | 3/1989 | Iwai | 440/66 |
| 5,149,284 | 9/1992 | Kawai | 440/52 |
| 5,219,306 | 6/1993 | Takahashi | 440/52 |

*Primary Examiner*—Sherman Basinger

*Attorney, Agent, or Firm*—Knobbe, Martens, Olson & Bear LLP

[57] ABSTRACT

A outboard motor mounting system where there is a device for connecting the steering shaft to the drive shaft housing and lower unit comprised of an attaching bracket at least partially encircling and engaging the drive shaft housing and lower unit. There is also a splash plate to deflect water splashed by the driveshaft housing and lower unit that is formed integrally with the attaching bracket comprising a surface extending forwardly and laterally from the main body of the attaching bracket.

10 Claims, 6 Drawing Sheets

OUTBOARD SPLASH PLATE ARRANGEMENT

BACKGROUND OF THE INVENTION

This invention relates to an arrangement for supporting an outboard drive unit and more particularly to an improved outboard splash arrangement for such a unit.

Most conventional outboard motor constructions employ a clamping bracket that is adapted to be affixed in a suitable manner to the hull of the associated watercraft and which pivotally supports a swivel bracket for tilt and trim movements. The swivel bracket, in turn, journals a steering shaft for steering movement about a generally vertically extending steering axis when the swivel bracket is tilted down. The steering shaft, in turn, is resiliently connected to the driveshaft housing so as to support the remaining components of the outboard motor on the clamping bracket. The resilient support is employed for reducing the transmission of vibration from the operation of the propulsion unit, including the powering internal combustion engine, to the hull.

Normally the driveshaft housing is a generally open casing made from a lightweight material such as aluminum or aluminum alloy casting. Conventionally the structure for attaching the lower end of the steering shaft to the driveshaft housing has been comprised of an attaching bracket comprised of two bracket members capturing a resilient member that engages a portion of the driveshaft housing at a lower end. Typically, the attachment bracket has typically been attached to the driveshaft housing at a point where only the two exterior walls of the driveshaft housing provide reaction support for the attachment bracket. Further, the bottom end of a steering shaft is located only partially down the side of the driveshaft housing and therefore the driveshaft housing may vibrate and cause vibrations to be transferred back into the watercraft.

Also, it is well known that as watercrafts with outboard motors travel through the water the portion of the driveshaft housing contacting the water and the associated hull splashes water upward from the surface of the water. In order to prevent the splashed water from impinging upon the upper portion of the outboard motor, splash plates are formed in the driveshaft housing and lower unit.

It is, therefore, a principal object of the this invention to provide an improvement to the rigidity of the mounting of the driveshaft housing to the steering shaft.

It is a further object of this invention to provide a mounting arrangement for the steering shaft of an outboard motor to the driveshaft housing that will not allow water to splash into the powerhead of the outboard motor.

SUMMARY OF THE INVENTION

This invention comprises an outboard motor comprised of a power head including an internal combustion engine and surrounding protective cowling. The motor also includes a drive shaft housing and lower unit depending from the engine. A drive shaft is journaled within the drive shaft housing and lower unit and driven by the engine. A propulsion device is located at the lower end of the drive shaft housing and lower unit and is driven by the drive shaft for propelling an associated watercraft. A steering shaft is disposed forwardly of the drive shaft housing and lower unit. There are also means for connecting the steering shaft to the drive shaft housing and lower unit comprised of an attaching bracket at least partially encircling and engaging the drive shaft housing and lower unit. A splash plate to deflect water splashed by the driveshaft housing and lower unit is formed integrally with said attaching bracket comprising a surface extending forwardly and laterally from the main body of the attaching bracket.

DETAILED DESCRIPTION OF THE PREFERRED EMBODIMENTS OF THE INVENTION

Figure 1:
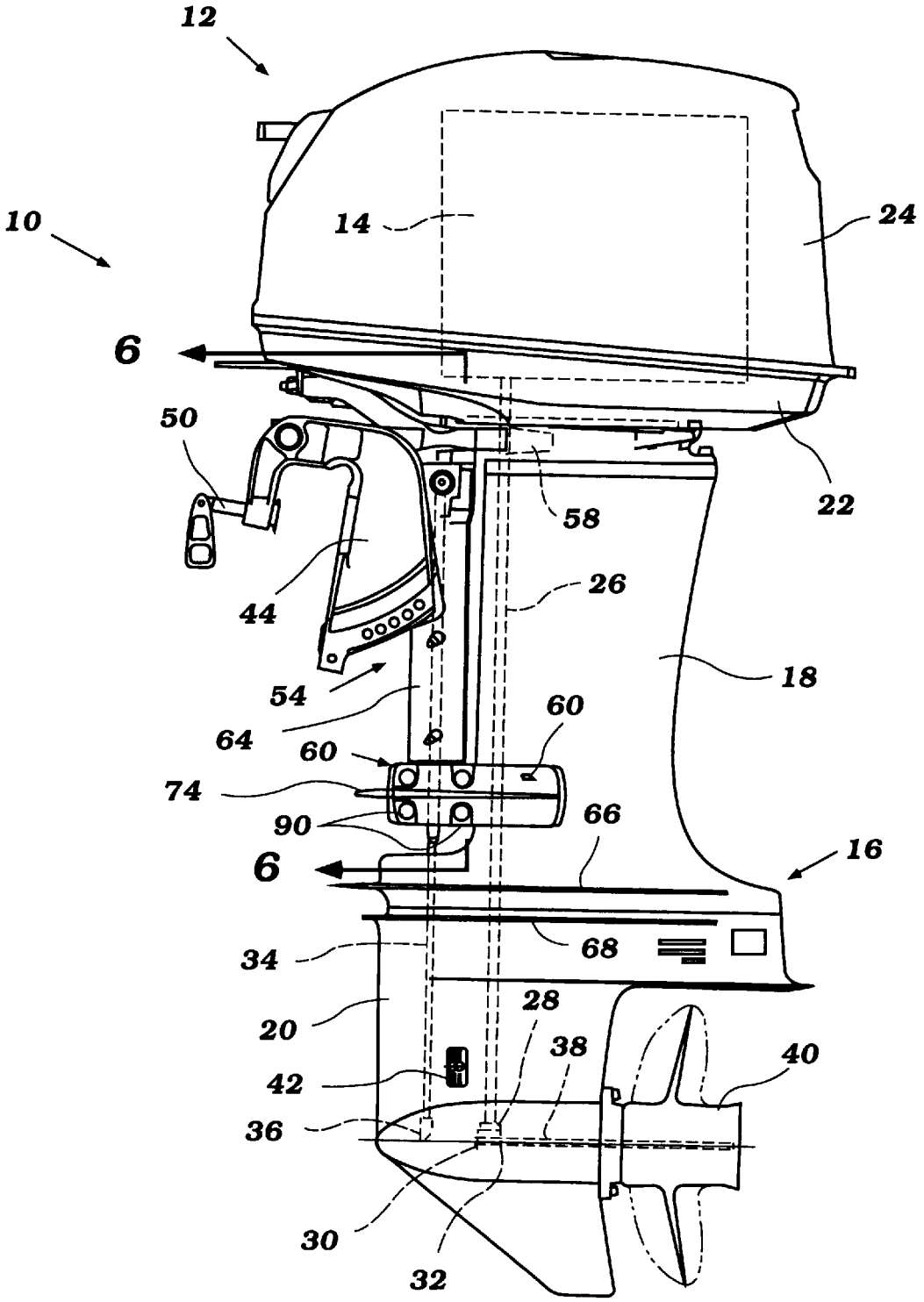
FIG. 1 is a side elevational view of an outboard motor constructed in accordance with this invention.

Referring first to FIG. 1, an outboard motor constructed in accordance with this embodiment of the invention is identified generally by the reference numeral 10. The outboard motor is comprised of a power head indicated generally by the reference numeral 12, which is comprised of an internal combustion engine 14, shown in rectangular dashed format, and is mounted to the upper end of a driveshaft housing and lower unit 16. The driveshaft housing and lower unit can be formed integrally or as a two separate parts. The preferred embodiment shows the driveshaft housing 18 as being separate from the lower unit 20. Typically the driveshaft housing 18 is formed as a casting from a lightweight material such as aluminum or an aluminum alloy. The lower unit 20 is provided at the lower end of the driveshaft housing 18.

The engine 14 may be of any known type and may be of the inline, two or three cylinder, or two cycle crankcase compression type. The details of the engine, such as the cylinder block, pistons and exhaust manifold are not shown in FIG. 1. This engine 14 is supported on a lower tray assembly which forms a portion of the protective cowling that encircles and protects the engine 14. The cowling is completed by an upper cowling member 24 which is detachably affixed to the tray 22 in a known manner.

The engine 14 is supported in the power head 12 so that its output shaft rotates about a generally vertically extending axis. The output shaft, not shown, is coupled in a known manner to a drive shaft 26 that depends through the driveshaft housing 18 and into lower unit 20 as best shown in FIG. 1. The driveshaft 26 is journaled in any suitable manner. At its lower end, the driveshaft 26 is coupled to a forward neutral reverse transmission. The drive shaft terminates at a bevel gear 28 that drives passive bevel gears 30 and 32 in a known manner.

The transmission, of which the details are not shown, is controlled by a shift rod 34 which is journaled for rotatable support in the lower unit 32. The shift rod is connected to a shift cam 36 for actuation of the transmission in a known manner. The transmission couples the drive shaft 26 to a propeller shaft 38 on which a propeller 40 is affixed in a known manner. The preferred embodiment illustrates an outboard motor with a propeller shaft and a conventional propeller. Nevertheless, any propulsion device could be utilized with the present invention.

The engine 14 is water-cooled and the water for its cooling system is drawn from the body of water in which the outboard motor 10 is operating. The cooling water is admitted through either water inlet opening 42 formed in the lower unit 20. A water pump, not shown, is mounted at the interface between the driveshaft housing 18 and the lower unit 20 and is driven by the driveshaft 26 in a known manner. The water pump draws water through the inlet 42 and delivers it upwardly to the engine 14 through a water supply conduit.

The engine 14 discharges its exhaust gases down into a silencing arrangement provided within an internal cavity in the driveshaft housing through an exhaust pipe not shown. The exhaust pipe extends into an expansion chamber formed at the rear of the driveshaft housing also not shown. The expansion chamber terminates at its lower end in an exhaust gas discharge formed in the lower unit 20 for delivering the exhaust gases to the atmosphere back through the body of water in which the associated watercraft is operating. A conventional through the propeller hub exhaust gas discharge may be provided for this purpose. Although the preferred embodiment illustrates an exhaust passage through the hub any type of conventional above-the-water exhaust gas discharge may be used with the present invention.

Continuing to refer to FIG. 1., the outboard motor 10 also includes a clamping bracket 44 which is adapted to engage the rear of the transom 46 of an associated watercraft 48. A clamping device 50 is also carried by the clamping bracket 44 and cooperates to affix the clamping bracket 44 to the transom 46 in a well known manner.

Figure 6:
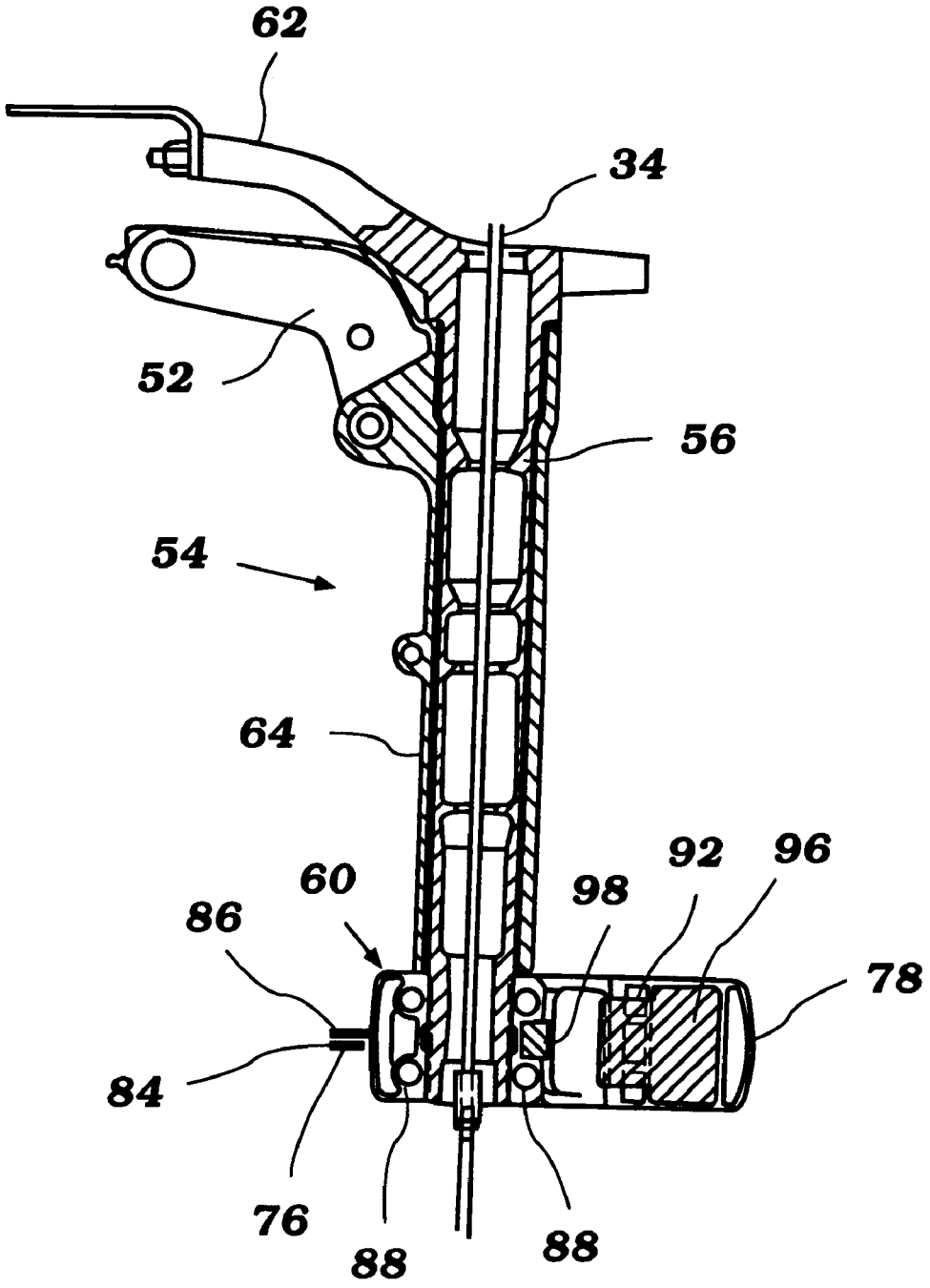
FIG. 6 is a partial cross section of FIG. 1 taken generally along the line 6—6.

A swivel bracket 52 is affixed for pivotal movement with respect to the clamping bracket 44 by means of a horizontally extending pivot pin as is best shown in FIG. 6. The pivotal connection permits tilt and trim movement of the outboard drive 10 relative to the hull of the associated watercraft 48, as is well known in the art. The components of the outboard motor 10 which have been described of the power head 12, driveshaft housing 18 and lower unit 20 are connected to the swivel bracket 52 by means of a steering arrangement, indicated generally as 54. The steering arrangement 54 includes a steering shaft 56 which appears in FIG. 1, and is connected to the driveshaft housing 18 and specifically its outer casing by an upper resilient attachment mechanism 58 and a lower resilient attachment bracket 60. The attachment bracket 60 embodies the invention.

The steering shaft 56 and the steering arrangement 54 includes a tiller 62 that is affixed to the upper end of the steering shaft 56 in a well known manner and is illustrated in FIG. 6. A steering handle, not shown, which may contain other controls for the outboard motor 10, is connected to the tiller 62 in a known manner. The steering shaft 56 is journaled in a downward cylindrical portion 64 of the swivel bracket 52. The steering shaft 56 thus rotates in the cylindrical portion 64 of the swivel bracket 52 during the course of normal turning operations of the watercraft 48. The lower end of the steering shaft 56 is rigidly fastened to the lower attachment bracket 60 so that an input into the tiller 62 rotates the steering shaft 56, in turn rotating the lower attachment bracket 60. The lower attachment bracket 60 thus inputs a turning force on the driveshaft housing and lower unit 16 thus enabling the outboard motor 10 to rotate with respect to the watercraft 48.

Figure 2:
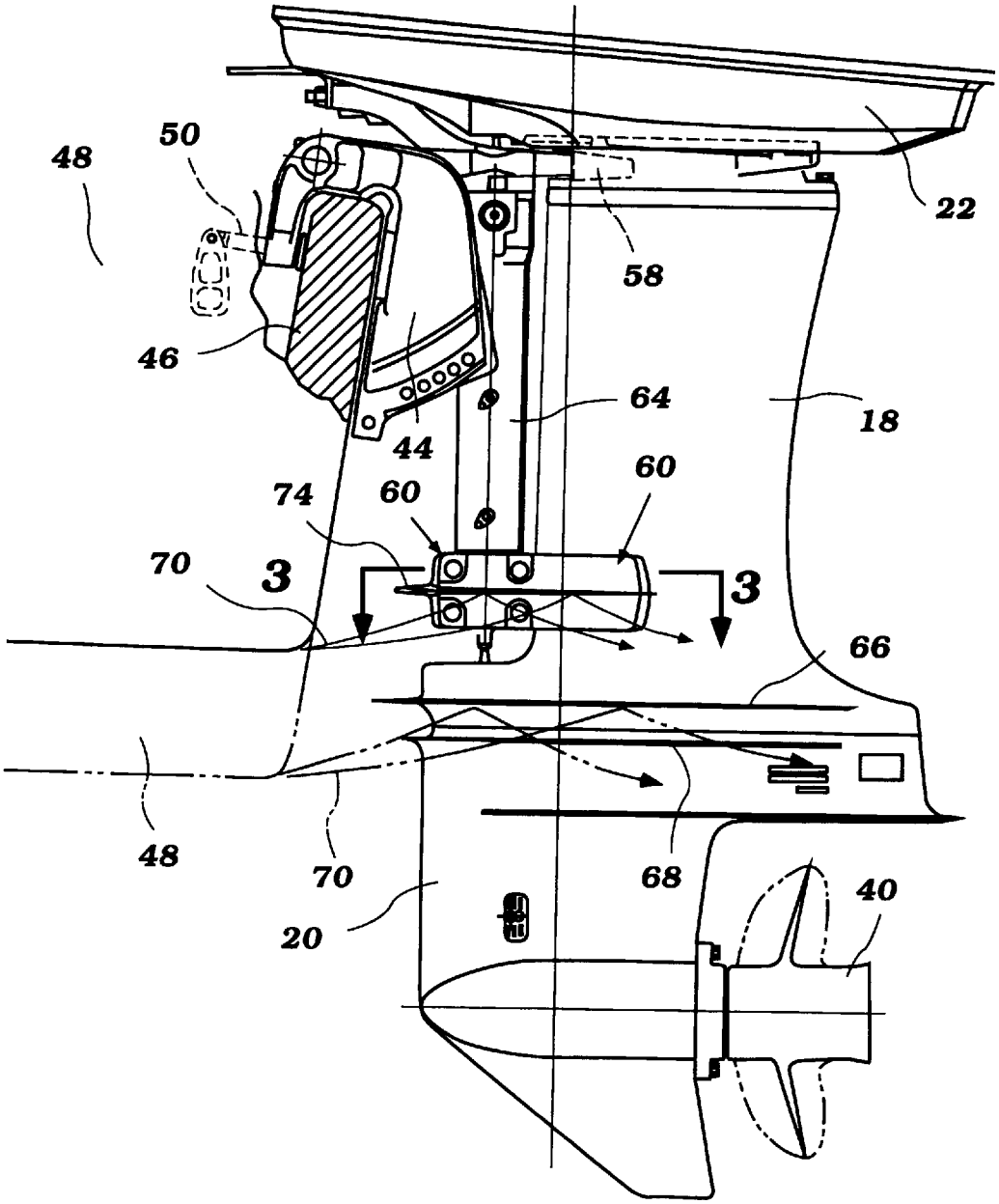
FIG. 2 is an enlarged view of the driveshaft housing and lower unit of the outboard motor of FIG. 1.

The drive shaft housing and lower unit 20 also include splash plates. In FIG. 1 and FIG. 2 the driveshaft housing 18 has an associated splash plate 66 and the lower unit 20 has an associated splash plate 68. The plate 66 is formed integrally with the driveshaft housing 18 and the plate 68 is formed integrally with the lower unit 20. The plates generally extend in the forward direction and laterally from the driveshaft housing and lower unit 20. Typically the height of the plates is greater than the amount they extend in the forward or lateral direction. The splash plates are designed to extend far enough to prevent the splash 70 which is caused by either the driveshaft housing and lower unit 16 or by the associated watercraft 48. The splash plates deflect the water away from the powerhead 16 of the outboard motor 10.

The splash plates are located in different height on the driveshaft housing and lower unit 16 to accommodate the splash caused when the watercraft 48 is operating at different heights in the water. During lower speed operation the watercraft 48 rides lower in the water than when the watercraft 48 is planed out at higher speeds. The structure of the outboard motor as thus far described may be considered to be conventional.

Figure 3:
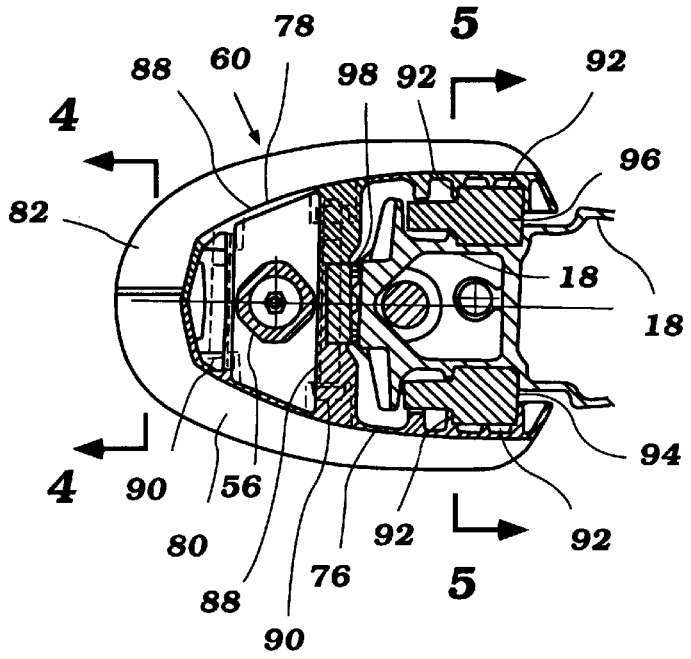
FIG. 3 is a partial cross section of FIG. 2 taken at line 3—3.
Figure 4:
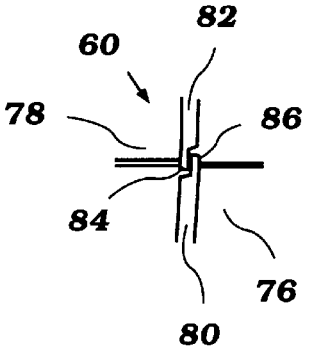
FIG. 4 is a partial cross section of FIG. 3 taken at line 4—4.
Figure 5:
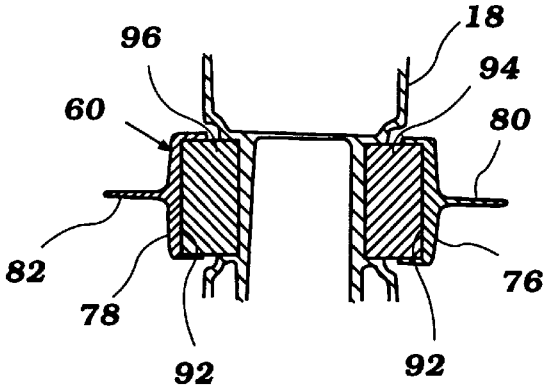
FIG. 5 is a partial cross section of FIG. 3 taken at line 5—5.

Referring now to the remaining FIG. 4, FIG. 5 and FIG. 6, the connection between the steering shaft 56, the swivel bracket 52, and the driveshaft housing 18 will be described. Referring first to FIG. 3, the driveshaft housing 18 defines an internal cavity. The internal cavity consists primarily of an exhaust expansion chamber communicating with the exhaust portion of engine 10.

The lower attaching bracket 60 contains an integrally formed splash plate 74 to deflect the splash created by the watercraft 48 or the driveshaft housing and lower unit 16 away from the powerhead 16 of the outboard motor 10. The attaching bracket 60 with the integral splash plate is shown in the preferred embodiment as two halves, however, the attaching bracket 60 could be constructed of more or fewer parts. The attaching bracket, as stated above, is designed in two halves 76 and 78 respectively. Each halve 76 and 78 has an integrally formed splash plate 80 and 82. The splash plates are shown as being mounted at the mid point of the height of the attaching bracket 60 but the invention should not be limited to a central mounting point on the attachment bracket 60.

The splash plates extend forwardly and laterally from the main body of the associated halves 76 and 78. The splash plates 80 and 82 extend forwardly and laterally greater than the height of the splash plate. At the forward most portion of the splash plates 80 and 82 there are mating portions 84 and 86 respectively. The mating portions 84 and 86 are formed into the splash plates and are designed to overlap each other when the two halves, 76 and 78, of the bracket 60 are assembled.

The two halves of the bracket 76 and 78 are mating parts that when placed together with the resilient mounts, discussed below, will form the complete attaching bracket 60. The halves 76 and 78 have bolt holes 88 formed integrally to accept a mechanical fastener to secure the two halves together. The bolts holes 88 are located in the forward portion of the mounting bracket 60 surrounding the bottom end of the steering shaft 56 as best shown in FIG. 2. Conventional bolts 90 are placed in the bolt holes 88 to secure the halves together.

In addition to the mating features of the brackets 78 and 80 the brackets also contain areas to envelop resilient mounts. These areas allow the completed attaching bracket to at least partially encircle and engage the driveshaft housing and lower unit. The recessed areas for enveloping the resilient mounts are show in FIG. 3 as 92. These areas 92 are integrally formed into the halves 76 and 78 and provide support for the resilient mounts that will be described below.

The resilient mounts lie between the driveshaft housing 18 and the respective bracket halves. One purpose for using resilient mounts is to provide support that will dampen vibrations and prevent transmitting the vibrations to the watercraft 48. The resilient mount 96 is trapped by the bracket half 78 and the external wall of the driveshaft housing 18. The resilient mount 94 is trapped between the bracket half 76 and the exterior wall of the driveshaft housing 18. A third resilient mount 98 is trapped in a recess formed at the intersection of the two mating bracket halves 76 and 78 and the front of the exterior of the driveshaft housing 18. In the preferred embodiment the resilient mounts are manufactured from a rubber compound, however, any resilient material could be substituted. Upon assembly of the attaching bracket 60 to the lower end of steering shaft 56 the resilient mounts 94, 96 and 98, trapped by the attaching bracket halves 76 and 78 partially encircle and engage the driveshaft housing and lower unit 16.

Figure 7:
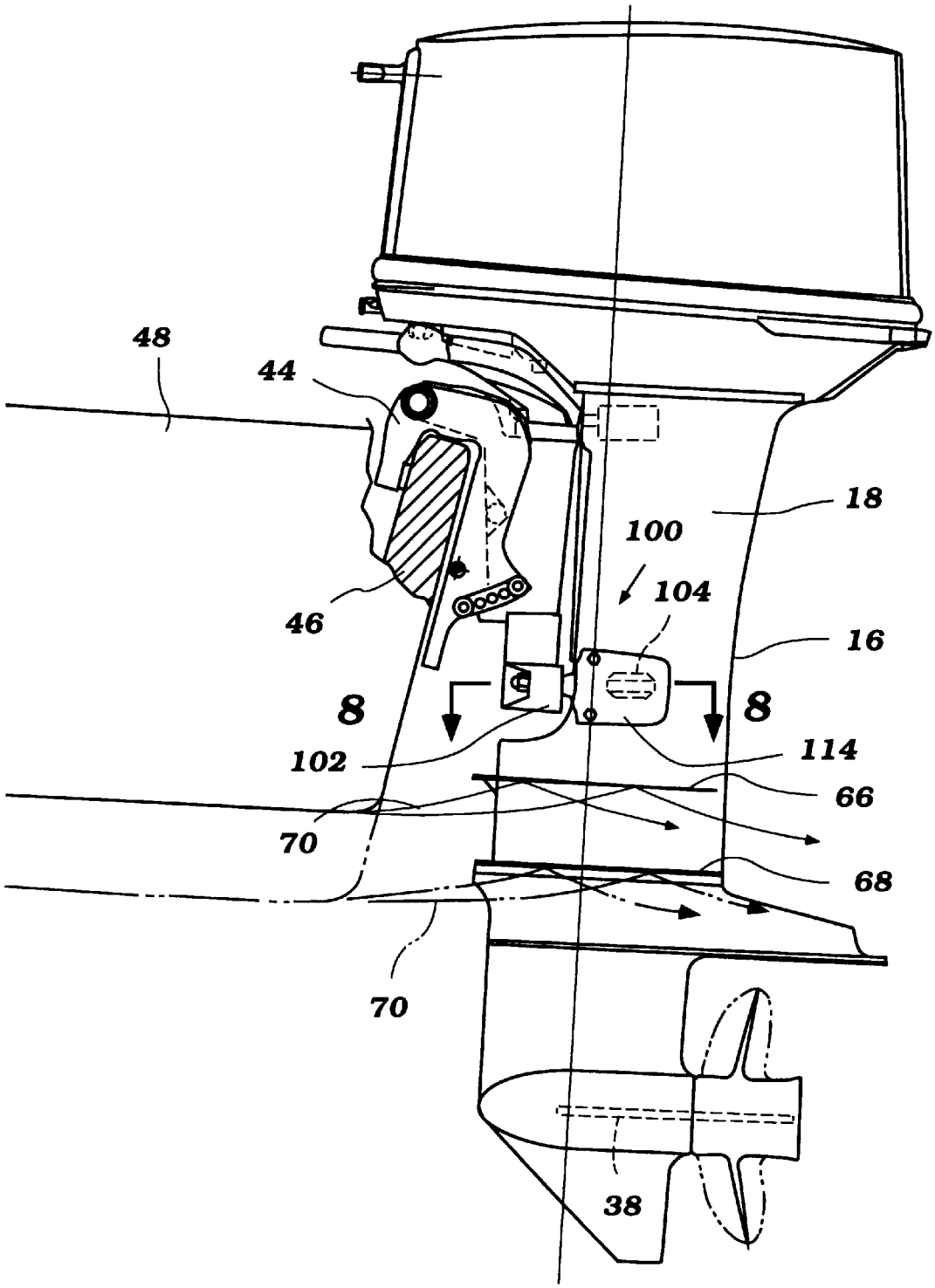
Figure 7 Prior Art
FIG. 7 is a side elevational view of an outboard motor of the prior art.
Figure 8:
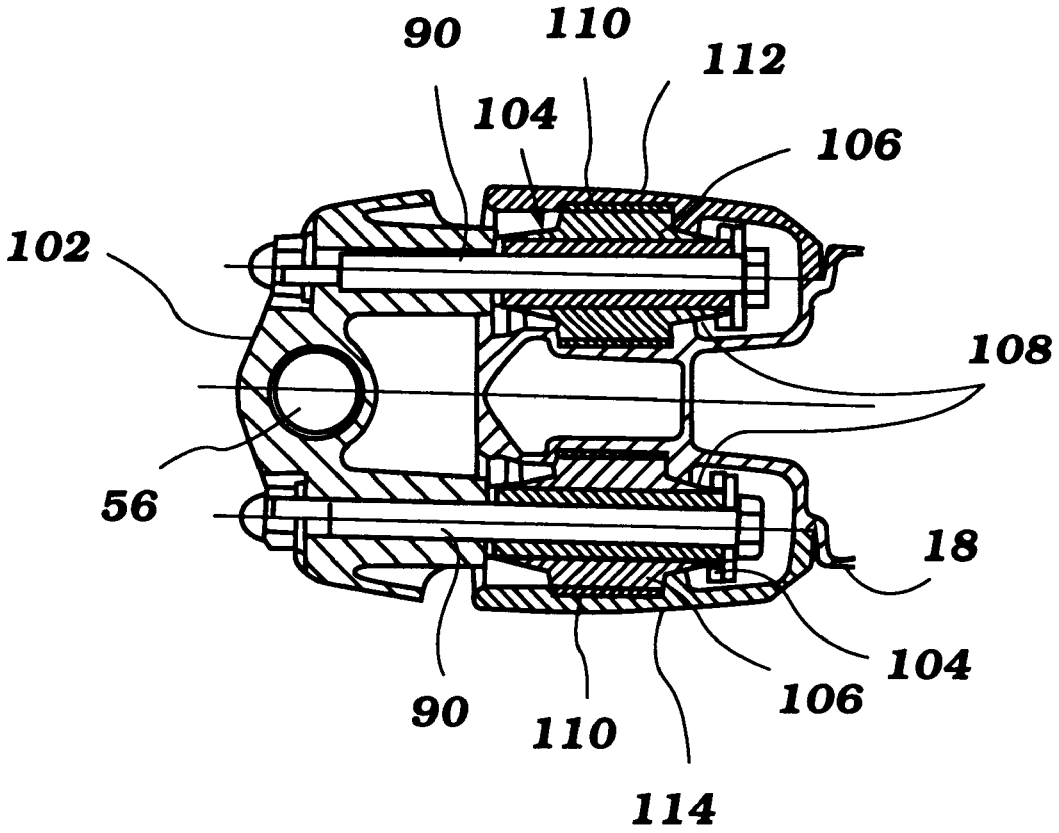
Figure 8 Prior Art
FIG. 8 is a partial cross section of FIG. 7 taken along the line 7—7.

In the prior art, as shown in FIG. 7 and FIG. 8 the splash plates are located on driveshaft housing and lower unit 16. The numbering for the prior art is the same as the current invention except for the attaching bracket. The attaching bracket of the prior art is generally referred to as reference numeral 100. The attaching bracket 100 contains a front portion 102 which is connected to the steering shaft 56. The front portion is connected to a rear portion with mechanical fasteners as known in the art. In the preferred embodiment the mechanical fasteners are bolts 90. The bolts 90 also provide support for the resilient mounts 104. The resilient lower mounts are constructed of a resilient material layer 106 which surrounds an inner cylinder 108. The outer perimeter of the resilient material layer is surrounded by an outer cylinder 110.

The outer cylinder 110 contacts and is engaged with rear portion of the bracket 112 and 114 respectively. The bracket 112 and 114 are connected to the driveshaft housing and lower unit by a plurality of mechanical fasteners as best shown in FIG. 7. The mechanical fasteners used in the prior art are bolts.

Of course, the foregoing description is that of preferred embodiments of the invention, and various changes and modifications may be made without departing from the spirit and scope of the invention, as defined by the appended claims.

What is claimed is:

1. An outboard motor comprised of a power head including an internal combustion engine and surrounding protective cowling, a drive shaft housing and lower unit depending from said engine, a drive shaft journaled within said drive shaft housing and lower unit and driven by said engine, a propulsion device at the lower end of said drive shaft housing and lower unit and driven by said drive shaft for propelling an associated watercraft, a steering shaft disposed forwardly of said drive shaft housing and lower unit and means for connecting said steering shaft to said drive shaft housing and lower unit comprised of an attaching bracket at least partially encircling and engaging said drive shaft housing and lower unit, a splash plate to deflect water splashed by said driveshaft housing and lower unit formed integrally with said attaching bracket comprising a surface extending forwardly and laterally from the main body of said attaching bracket.

2. An outboard motor of claim 1 wherein the length of said splash plate in the forward and lateral directions is greater than the height of said splash plate.

3. An outboard motor of claim 1 wherein said driveshaft housing and lower unit includes at least one splash plate.

4. A outboard motor of claim 1 wherein said attaching bracket is located on the end of said steering shaft.

5. A outboard motor of claim 1 wherein said attaching bracket further comprises, at least one bracket at least in part enveloping a resilient mount.

6. An outboard motor of claim 1 wherein the forward portion of the drive shaft housing adjacent the steering shaft is disposed to the rear of the steering shaft.

7. An outboard motor of claim 6 wherein the attaching bracket spans the lower end of the area between the forward edge of the drive shaft housing and the steering shaft.

8. An outboard motor of claim 7 wherein the length of said splash plate in the forward and lateral directions is greater than the height of said splash plate.

9. An outboard motor of claims 8 wherein said driveshaft housing and lower unit includes at least one splash plate.

10. A outboard motor of claim 9 wherein said attaching bracket is fixed to the lower end of said steering shaft.

* * * * *